US011866859B2

(12) United States Patent
Pollet et al.

(10) Patent No.: US 11,866,859 B2
(45) Date of Patent: Jan. 9, 2024

(54) TEXTILE MACHINE, WEAVING LOOM COMPRISING SUCH A TEXTILE MACHINE AND ASSOCIATED METHODS

(71) Applicant: STAUBLI FAVERGES, Faverges-Seythenex (FR)

(72) Inventors: Francois Pollet, Annecy le Vieux (FR); Pierre Aubert, Faverges Seythenex (FR); Patrice Przytarski, Chaponnay (FR); Philippe Vandroux, Chassieu (FR)

(73) Assignee: STAUBLI FAVERGES, Faverges-Seythenex (FR)

( * ) Notice: Subject to any disclaimer, the term of this patent is extended or adjusted under 35 U.S.C. 154(b) by 212 days.

(21) Appl. No.: 17/618,624

(22) PCT Filed: Jun. 19, 2020

(86) PCT No.: PCT/EP2020/067107
§ 371 (c)(1),
(2) Date: Dec. 13, 2021

(87) PCT Pub. No.: WO2020/254581
PCT Pub. Date: Dec. 24, 2020

(65) Prior Publication Data

US 2022/0259777 A1 Aug. 18, 2022

(30) Foreign Application Priority Data

Jun. 19, 2019 (FR) ..... 1906582

(51) Int. Cl.

| | |
|---|---|
| ***D03J 1/00*** | (2006.01) |
| ***D03C 1/14*** | (2006.01) |
| ***D03C 3/32*** | (2006.01) |
| ***D03C 19/00*** | (2006.01) |
| *D03J 1/24* | (2006.01) |

(52) U.S. Cl.
CPC ..... *D03J 1/00* (2013.01); *D03C 1/14* (2013.01); *D03C 3/32* (2013.01); *D03C 19/005* (2013.01)

(58) Field of Classification Search
CPC .... D03J 1/00; D03C 1/14; D03C 3/32; D03C 19/005; D03C 5/00; D03C 19/00
See application file for complete search history.

(56) References Cited

U.S. PATENT DOCUMENTS

| | | | | | |
|---|---|---|---|---|---|
| 3,205,537 | A * | 9/1965 | Reiterer | D01G 15/20 | 19/105 |
| 5,495,568 | A * | 2/1996 | Beavin | G09B 23/30 | 700/83 |
| 5,642,757 | A * | 7/1997 | Froment | D03C 3/32 | 139/59 |
| 5,676,329 | A * | 10/1997 | Bertoli | B65H 59/24 | 242/486.3 |
| 5,805,452 | A * | 9/1998 | Anthony | G05B 13/026 | 700/142 |
| 5,834,639 | A * | 11/1998 | Meier | D01H 13/22 | 73/159 |
| 5,888,609 | A * | 3/1999 | Karttunen | C04B 38/0022 | 442/310 |
| 6,357,486 | B2 * | 3/2002 | Braun | D03D 51/46 | 139/59 |
| 6,415,045 | B1 * | 7/2002 | Quigley | G01N 21/89 | 702/34 |
| 7,154,081 | B1 * | 12/2006 | Friedersdorf | G01B 11/18 | 250/227.16 |
| 7,753,084 | B2 * | 7/2010 | Gielen | D03D 47/306 | 139/435.3 |
| 7,851,388 | B2 * | 12/2010 | Kim | D06N 3/0009 | 473/421 |
| 8,124,175 | B2 * | 2/2012 | Kim | D04B 21/16 | 66/195 |
| 8,915,201 | B2 * | 12/2014 | Rippert | B29C 70/086 | 112/470.14 |
| 9,297,708 | B1 * | 3/2016 | Morris | G01M 11/086 | |
| 10,018,569 | B2 * | 7/2018 | Evans | H04B 10/25 | |
| 10,304,137 | B1 * | 5/2019 | Genser | G06Q 40/08 | |
| 10,332,318 | B1 * | 6/2019 | Leise | H04W 4/80 | |
| 10,449,922 | B2 * | 10/2019 | Yoshida | B60R 21/23 | |
| 10,613,517 | B2 * | 4/2020 | Allardice | G05B 19/4141 | |
| 10,691,119 | B2 * | 6/2020 | Locatelli | G05B 23/0283 | |
| 10,808,873 | B2 * | 10/2020 | Tiberghien | F16L 37/138 | |
| 10,846,322 | B1 * | 11/2020 | Ghamsari | G06F 16/51 | |
| 11,262,009 | B2 * | 3/2022 | Tiberghien | F16L 37/0841 | |
| 11,746,942 | B2 * | 9/2023 | Durieux | F16L 41/12 | 251/149.6 |
| 2002/0083283 | A1 * | 6/2002 | Barret | G06F 21/71 | 711/158 |
| 2005/0139001 | A1 * | 6/2005 | van Schoor | G01M 5/0025 | 73/159 |
| 2006/0106492 | A1 * | 5/2006 | Gerat | B25J 9/1602 | 700/245 |
| 2006/0126375 | A1 * | 6/2006 | Bonzo | G11C 11/417 | 365/154 |
| 2006/0270300 | A1 * | 11/2006 | Kim | D06C 7/02 | 442/164 |

(Continued)

FOREIGN PATENT DOCUMENTS

| | | |
|---|---|---|
| CN | 101089269 A | 12/2007 |
| CN | 103221596 A | 7/2013 |

(Continued)

OTHER PUBLICATIONS

International Search Report for PCT/EP2020/067107, dated Oct. 16, 2020.

(Continued)

*Primary Examiner* — Robert H Muromoto, Jr.

(57) ABSTRACT

A textile machine (4) for a weaving loom having an input shaft which is coupled to a weaving loom. The drive mechanism is driven by the input shaft to move frames or collars of the weaving loom through a sequence of predefined positions. The electronic control device is programmed to monitor the change in position of each frame or collar during each step of the predefined sequence of positions and to count the number of times each frame or collar reproduces a particular configuration.

14 Claims, 4 Drawing Sheets

(56) References Cited

U.S. PATENT DOCUMENTS

2007/0100565 A1* 5/2007 Gosse ..... G06F 30/23 702/34
2007/0293976 A1* 12/2007 Puget ..... D03C 3/20 700/140
2008/0147238 A1* 6/2008 Joly ..... G05B 19/237 700/260
2009/0259433 A1* 10/2009 Jacquot ..... G01B 11/08 901/14
2009/0288732 A1* 11/2009 Gielen ..... D03D 47/306 139/435.3
2010/0263504 A1* 10/2010 Rippert ..... B29C 70/24 83/13
2012/0067108 A1* 3/2012 Niklaus ..... G01N 33/367 73/7
2012/0126803 A1* 5/2012 Goldfine ..... G01R 33/0094 324/239
2012/0230668 A1* 9/2012 Vogt ..... H04N 23/50 396/428
2013/0116821 A1* 5/2013 Joly ..... G05B 19/4086 700/254
2013/0131864 A1* 5/2013 Jody ..... B25J 9/023 901/23
2014/0103942 A1* 4/2014 Izrailit ..... F16C 17/246 324/649
2014/0174577 A1* 6/2014 Tiberghien ..... F16L 37/35 137/798
2014/0240069 A1* 8/2014 Tiberghien ..... B25B 11/002 335/295
2016/0010802 A1* 1/2016 Leavitt ..... F17C 13/02 356/402
2017/0088981 A1* 3/2017 Vandroux ..... D03C 3/32
2017/0334388 A1* 11/2017 Yoshida ..... B60R 21/235
2018/0257226 A1* 9/2018 Civette ..... B25J 9/1602
2019/0138926 A1* 5/2019 Huang ..... G06F 30/20
2021/0012243 A1* 1/2021 Chen ..... G06N 20/00
2021/0030173 A1* 2/2021 Ross ..... A47G 9/02
2021/0302385 A1* 9/2021 Jack ..... G01N 29/4472
2021/0372016 A1* 12/2021 Tremer ..... D03D 47/23
2021/0388543 A1* 12/2021 Hagihara ..... D03D 15/533
2022/0009251 A1* 1/2022 Shinagawa ..... B65H 3/44
2022/0259777 A1* 8/2022 Pollet ..... D03C 19/00
2023/0085521 A1* 3/2023 Hagihara ..... G06F 3/014
2023/0148077 A1* 5/2023 Hagihara ..... A61B 5/11 324/699

FOREIGN PATENT DOCUMENTS

CN 103429802 A 12/2013
CN 109790657 A 5/2019
DE 3724448 A1 2/1988
DE 69115873 T2 8/1996
EP 0493868 A1 7/1992
WO 02086214 A2 10/2002

OTHER PUBLICATIONS

French Search Report for France Application No. 870075, dated Feb. 6, 2020.

* cited by examiner

TEXTILE MACHINE, WEAVING LOOM COMPRISING SUCH A TEXTILE MACHINE AND ASSOCIATED METHODS

TECHNICAL FIELD

The present invention relates to a textile machine. The invention also relates to a weaving loom comprising such a textile machine as well as to methods for operating such a textile machine and such a weaving loom.

BACKGROUND

The invention is particularly applicable to the field of weaving looms and especially to textile machines intended for forming a shed that have an input shaft driven by a weaving loom, such as basic weaving machines, dobbies and Jacquard machines.

To plan textile machine maintenance, these typically include a counter that measures the run time of certain machine components. When the run time of one of these components exceeds a preset value, the user is prompted to replace that component, or to clean or recondition it. Other machines use counters that count the number of movements or use cycles of certain machine components.

One disadvantage of the known measurement systems is that they are relatively basic and do not make it possible to quantify the precise state of wear of a component, which, inter alia, does not make it possible to set up preventive maintenance measures and, in the worst case, can give an erroneous view of the state of wear of the machine components.

There is therefore a need for an improved textile machine that makes it possible to determine the state of wear of one or more machine components simply and more accurately.

SUMMARY

To this end, the invention relates to a textile machine for a weaving machine, comprising:

- an input shaft configured to be coupled to a weaving loom;
- a drive mechanism actuated by the input shaft and configured to move frames or collars of the weaving loom, according to a predefined sequence of positions, said drive mechanism having at least one mechanical output component configured to be coupled to one of said frames or collars of the weaving loom;
- an electronic control device comprising a processor and a computer memory, wherein the control device is programmed to monitor the change in position of each frame or collar during each step of the predefined sequence of positions and to count the number of times each frame or collar reproduces a particular configuration.

In this way, the invention makes it possible to take into account the intensity with which the machine components are individually stressed, particularly for the mechanical components involved in the force transmission kinematics. This makes it possible to know the individual state of wear of these components more precisely than by being based on an overall measurement of the machine's operating time.

Indeed, the mechanical stresses undergone individually by the machine components are not homogeneous for the whole machine and can be more or less important, moreover, depending on the nature and the pattern of the fabric being manufactured, and depending in particular on the fabric design (or weave), which defines the sequence of positions imposed on the frames and/or collars of the weaving machine. However, a textile machine can be used to weave fabrics of a different nature. For example, the warp tension is more important when weaving an upholstery fabric than when weaving a garment fabric.

The particular patterns recognized by the control device make it possible to identify the movements of the textile machine components in particular. Their wear is directly related to the number of times they are in motion and can vary, depending on the nature of the movement.

Another advantage of the invention is that information on the state of wear can be obtained for each component, in particular for each frame or collar of the machine, without the need to know precisely the complete path followed by this frame or collar.

As such, the weave used to manufacture the fabric cannot be reconstructed from data collected by the measurement system, and thus remains confidential. In other words, the weave used cannot be disclosed to a maintenance provider from the information collected by the measurement system.

According to advantageous but non-mandatory aspects, such a machine may incorporate one or more of the following features, taken alone or in any technically permissible combination:

- said particular configurations comprise the following frame or collar transitions for each step of the predefined sequence of positions:
  - the frame or collar remains stationary in a high position;
  - the frame or collar remains stationary in a low position; or
  - the frame or the collar initiates a movement from a high position to a low position;
  - the frame or collar initiates a movement from a low position to a high position;
  - the frame or collar continues a movement from a high position to a low position;
  - the frame or collar continues a movement from a low position to a high position.
- The machine further comprises a measuring device comprising one or more sensors configured to measure one or more of the following quantities for each step of the predefined position sequence:
  - a force exerted on a mechanical component;
  - a torque exerted on a mechanical component;
  - a position of one or more of the frames or collars;
  - an angle of the input shaft;
  - a speed of rotation of the input shaft;
  - an environmental variable such as a temperature, or viscosity, or pressure, or opacity.
- The control device is programmed to calculate a reference value for a measured quantity over a weave cycle and, for each weave cycle, to automatically compare the measured quantity to the reference value.
- The control device is programmed, for each step of the predefined position sequence, to automatically compare the position of each weaving loom frame or collar with a target position imposed by the predefined position sequence.
- The control device is programmed, for at least some of the textile machine components, to automatically calculate a severity index, defined as a current level of use of the component relative to an intrinsic component limit.
- The control device is programmed, for at least a portion of the textile machine components, to automatically calculate a cumulative damage index, defined as the state of wear of the component relative to a reference state.

The control device is programmed to automatically compare a severity index or damage index, for at least a portion of the textile machine components, to a predefined value, and to update a state variable representing the comparison.

The textile machine is a shedding device, such as a basic weave machine, a Dobby or a Jacquard machine.

The control device has a memory with a maintenance file containing the recording of counters or a severity index or a damage rate for at least one of the textile machine components.

The textile machine components recorded in the maintenance file include one or more of the following components:

blades or collars, electromagnets, selection modules, filters, oil.

The control device is adapted to communicate with a remote server.

According to another aspect, the invention relates to a system comprising a weaving loom and a textile machine according to the claimed invention, said textile machine being coupled to the weaving loom.

According to another aspect, the invention relates to a method for operating a measuring system equipping a textile machine for a weaving machine, said textile machine comprising:

an input shaft configured to be coupled to a weaving loom;

a drive mechanism actuated by the input shaft and configured to move frames or collars of the weaving loom through a predefined sequence of positions, said drive mechanism having at least one mechanical output component configured to be coupled to one of said frames or collars of the weaving loom; and an electronic control device comprising a processor and a computer memory, wherein the method comprises monitoring the change in position of each frame or collar of the weaving loom during each step of the predefined sequence of positions and counting the number of times each frame or collar reproduces a particular configuration.

According to one alternative embodiment, the method further comprises automatically calculating a maintenance indicator representing a wear condition of one or more mechanical textile machine components from the recorded position data of each frame or collar.

BRIEF DESCRIPTION OF THE DRAWINGS

The invention will be better understood and other advantages thereof will become clearer in the light of the following description of embodiments of a textile machine given only by way of example and made with reference to the appended drawings, in which.

DETAILED DESCRIPTION OF SOME EMBODIMENTS

Figure 1:
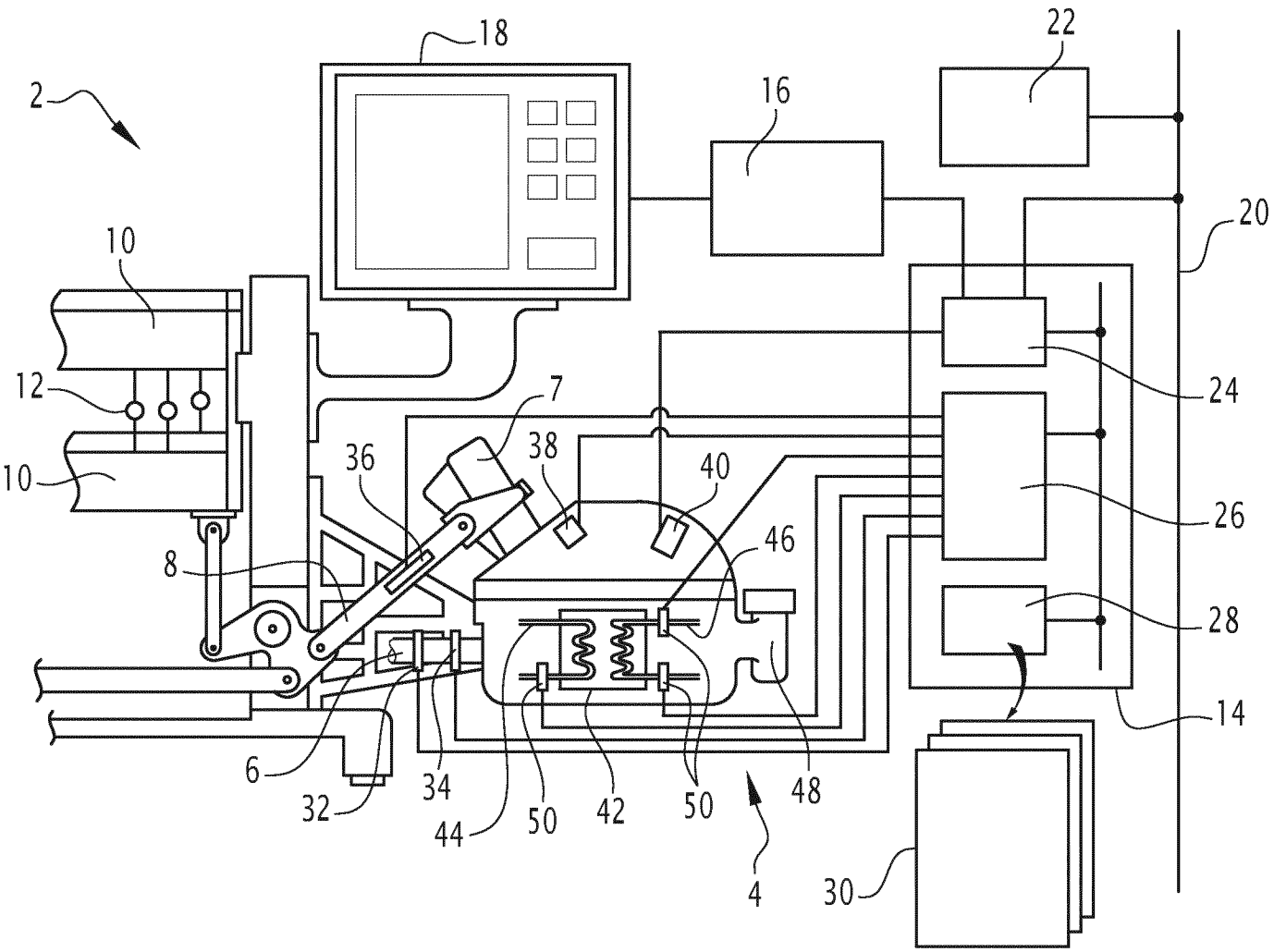
FIG. 1 shows a weaving loom comprising a dobby according to one embodiment of the invention.

FIG. 1 shows a weaving loom 2 associated with a textile machine, such as a shedding device. In this embodiment, the textile machine 4 is a dobby.

The machine 4 comprises an input shaft 6 coupled to the weaving loom 2, to be rotated by an actuator (not shown) of the weaving loom 2.

The machine 4 further comprises a drive mechanism actuated by the input shaft 6 and including mechanical output components 7 and mechanical transmission components 8 configured to move frames 10 of the weaving loom 2 in a predefined sequence of positions.

In other words, the machine 4 is configured to transform the continuous rotational movement of the input shaft 6 into a plurality of alternating translational movements of the frames 10 between an up position and a down position, depending on the predefined sequence of positions.

The frames 10 are coupled to the output components 7 by a kinematic chain formed by mechanical elements including transmission elements 8 in particular, these elements being connected to each other by pivot links.

Healds 12 are connected to the frames 10. The movement of the healds 12 allows a piece of fabric to be woven in a particular pattern defined by a weave selected by a user. In other words, the predefined sequence of positions is defined by a weave selected by a user.

In FIG. 1, the frames 10 of the weaving loom 2 are only partially drawn.

For example, the output components 7 are output levers and the transmission components 8 are the first transmission rods. Each first rod is articulated here, directly or indirectly, by its opposite ends, to an output lever 7 on the one hand and to one of the frames 10 on the other.

During the operation of the machine 4, the rotational movement delivered by the input shaft 6 is transformed into an oscillating movement of the output levers 7 by the drive mechanism depending on the weave chosen.

In other words, the predefined position sequence defines the position of each frame 10 sequentially. In practice, each step in the sequence corresponds to one pick of fabric. For each step, at least a portion of the frames 10 are moved simultaneously, while the other portion of the frames 10 may remain stationary. The predefined sequence of positions can be repeated cyclically, so that the same pattern is repeated throughout the fabric. Each cycle here corresponds to the length of the weave, also called the weave cycle.

The movement of the output levers 7 is, controlled by electromechanical or electronic regulating means, for example, driven depending on the weave chosen.

In the illustrated example, the machine 4 comprises an electronic control device 14, one function of which is to automatically control the positioning of the output levers 7 in a position in accordance with a set position imposed by the weave, while taking into account the angular position of the input shaft 6, so that the frames 10 are moved in a synchronized manner with the movement of the weaving loom 2.

For example, the movement of the output levers 7 is controlled by the control device 14 through electromagnets 40 configured to selectively disengage output levers 7 from a drive shaft driven by the input shaft 6. In the illustrated example, the machine 4 is a rotary dobby with sixteen output levers, this example not necessarily being limiting.

In many embodiments, the weaving loom 2 includes an electronic control device 16 and a human/machine interface 18 that allows a user to operate the weaving loom 2. The interface 18 includes a display screen and/or a touch screen, and/or data input means such as a keyboard or buttons or the like, for example. The interface 18 may be mounted on a control console of the weaving loom 2.

The control device 14 is preferably connected to the control device 16 of the weaving loom 2. For example, the latter automatically transmits weave indications to the control device 14 relating to the operating mode of the weaving loom 2 (weaving loom at a standstill, weaving loom in slow motion, weaving loom in reverse motion, weaving) as well as configuration parameters, such as the shed angle.

The control device 14 is adapted to be connected to a communications network 20 such as the internet or a local area network by a wired or wireless communications link. The control device 14 is thus suitable for connection to a remote computer server 22.

According to embodiments given as examples, the control device 14 comprises a processor 24, a data acquisition interface 26 and one or more computer memories 28 configured in particular to store maintenance files 30.

Although not illustrated, the control device 14 may further comprise a communications interface, to be connected to the network 20, as well as a connection interface to be connected to said actuating means of the machine 4, via a wire link or a field bus, for example.

The processor 24 is a programmable microprocessor or micro-control device, for example. However, other circuits types such as a programmable logic component of the FPGA type or a dedicated integrated circuit can be used in variants.

The acquisition interface 26 is configured to acquire and possibly reprocess measurement signals from sensors integrated in the machine 4. For example, the acquisition interface 26 may comprise an analog-to-digital converter or a digital signal processor.

According to examples, the memory 28 is a ROM memory, or a RAM memory, or a non-volatile memory, for example of EEPROM or FLASH technology, or an optical memory, or a magnetic memory, or any similar memory.

Figure 4:
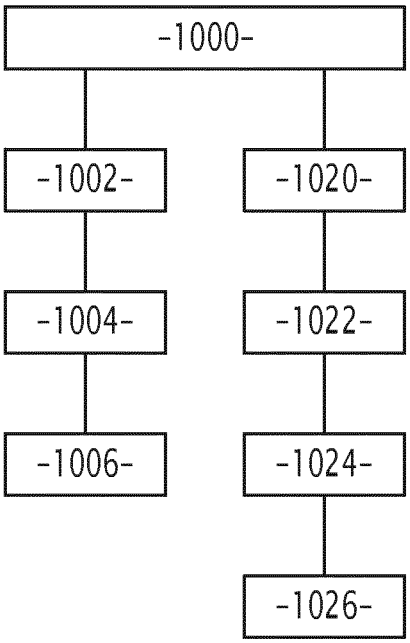
FIG. 4 shows a method for operating a measuring system fitted to a textile machine according to one embodiment of the invention.

In particular, the memory 28 includes executable instructions and/or software code for implementing a method for operating the machine 4, as well as the method in FIG. 4, when executed by the processor 24.

The maintenance files 30 may include a component list of the machine 4 with related characteristics, for which maintenance indicators calculated by the control device 14 may be defined.

For example, for each component of the machine 4, and more particularly for the components likely to be targeted by maintenance operations, the maintenance file 30 includes a related status variable that can have a value from among several predefined values.

These maintenance files 30 may also include configuration parameters of the machine 4, such as stroke values for each frame, or oil viscosity values for different temperatures or more generally any relevant technical parameter relating to one or more of the components of the machine 4.

For example, the term "file" is not limiting and the maintenance files 30 can in a variant be implemented by any appropriate data structure, such as a linked list or a relational database.

In general, the machine 4 includes a measuring device comprising one or more sensors configured to measure one or more of the following quantities for each step of the predefined position sequence:

- a force exerted on a mechanical component;
- a torque exerted on a mechanical component;
- a position of one or more of the frames;
- an angle of the input shaft;
- a speed;
- an environmental variable such as a temperature, or a viscosity, or a pressure, or an opacity.

These sensors are connected to the interface 26 of the control device 14.

In this example, the machine 4 includes:

- a sensor 32 mounted around the input shaft 6 and configured to measure the mechanical torque exerted on the input shaft 6;
- an angle sensor 34, such as a rotary encoder, coupled to the input shaft 6 to measure the instantaneous angular position of the input shaft 6;
- a force sensor 36, comprising a strain gauge bridge, mounted on the first transmission link 8 associated with the first frame, to measure a force exerted in the first link 8, for example;
- a position sensor 38, such as a proximity sensor (for example an optical or capacitive or magnetic sensor), associated with each output lever 7;
- a plurality of temperature sensors 50 installed in a cooling circuit of the machine 4.

For example, the cooling circuit of the machine 4 includes a heat exchanger 42 associated with a cooling water circuit 44 and an oil circuit 46.

For example, the oil circulates inside the machine 4 in a lubrication circuit that includes a pump, drawing oil collected in a housing of the machine 4 through a filter 48 and delivering it to the exchanger 42. The oil is then conveyed to lubrication points.

Temperature sensors 50 are arranged, for example, at the inlet of the exchanger 42 for each circuit 44 and 46 and at the outlet of the exchanger for the oil circuit 46.

In general, the control device 14 is configured to monitor in real time the condition of the machine during its operation and accordingly to calculate maintenance indicators that reflect the state of wear and/or stress of certain components of the machine 4, in particular with a view to facilitating maintenance of the machine 4.

In particular, the control device 14 is configured to monitor the evolution of each frame position during each step of the predefined sequence of positions and, for each frame, to identify particular configurations and to count how many times they recur.

For example, the particular configurations correspond to the following transitions of the frame 10 for each step (each diute) of the predefined position sequence:

- the frame 10 remains stationary in a high position;
- the frame 10 remains stationary in a low position;
- the frame 10 initiates a movement from a high position to a low position (the frame having remained stationary in the previous step);
- the frame 10 initiates a movement from a low position to a high position (the frame having remained stationary in the previous step);
- the frame 10 continues a movement from a high position to a low position (the frame having already moved in the previous step);
- the frame 10 continues a displacement from a low position to a high position (the frame having already moved in the previous step).

Indeed, the mechanical stresses exerted during a non-stop frame movement from a high position to a low position are not the same as the mechanical stresses exerted during the frame starting from the high position, for example.

In the embodiment, recognition of the particular configurations is carried out from the weave-compliant frame position transmitted by the control device 16 of the weaving loom 2 to the control device 14. Thus, for each pick, the control device 14 has each frame position desired and also each frame position at the preceding and following picks. It can thus identify the particular configuration reproduced by each frame.

According to embodiments, the position information of the frame 10 is determined by the control device 14 from position information of the output components 7 or the transmission components 8 coupled to the frames 10.

According to one example, the movement of the frame 10 is determined automatically from the activation sequence of the electromagnets 40 applied by the control device 14 when driving the positions of the output levers 7.

According to another example, the movement of the frame 10 is extrapolated from a measurement of the actual movement of the output lever 7 through the displacement sensors 38.

Associated with to each blade are counters that each correspond to one of the particular configurations sought. For each pick, the control device 14 updates the counters. These counters are stored in the maintenance file 30. The counters associated with each blade give information on the intensity required of said blade during the operation of the machine 4.

The status of all the counters stored in the maintenance file 30 forms a maintenance indicator, for example.

Thus, the invention makes it possible to take into account the intensity with which the machine components are individually stressed, particularly for the mechanical components involved in the force transmission kinematics. Furthermore, information on the state of wear and stress for each frame 10 of the machine is obtained without the need to disclose the weave used to a maintenance provider.

According to embodiments, the control device 14 acquires the force measurement in the first transmission rod 8 via the force sensor 36, and conditions this measurement as a maximum force and an equivalent force. As the force in the connecting rod is variable, it is necessary to have a significant value for these variations.

In the present case, with the lifespan calculation model being that of the bearings, the equivalent force $F_{equi}$ is calculated for a weave cycle by using the following formula:

$$\text{Féqui} = \sqrt[p]{\int_0^T F(t)^p dt} \qquad \text{[Math 1]}$$

Where "p" is an exponent worth 3 for ball bearings and 10/3 for roller bearings, F(t) is the force measured depending on the time, T is the recurrence period of the force (duration of execution of a weave cycle).

In addition, the control device 14 extrapolates these forces to obtain the forces in the other 15 rods based on frame strokes recorded in the configuration parameter file.

In a variant, the frame strokes could come from direct measurements or from processing force measurements.

In extrapolating the forces for the other frames, the control device 14 takes into account the weave analysis. Indeed, for the same blade, the forces corresponding to a non-stop transition from the high to the low position are not the same as the forces corresponding starting from the high position.

The control device 14 collects the measurements of the angular position sensor of the input shaft and proceeds to a derivation in relation to time to obtain the weaving speed, for example in number of picks per minute.

The weaving speed is also available from the weaving loom control device 16, as is information relating to the mode of operation. The dobby control device 14 can thus determine whether it should take the measurements into account when updating the counters. For example, it will not take into account measurements made when the weaving loom is running in slow speed mode.

According to embodiments, the control device 14 is further programmed to automatically calculate severity indices for at least some of the textile machine components, defined as the current component use level relative to an intrinsic component limit.

For example, this severity index shows the stress intensity required at a given time.

According to one example, a load severity index is defined for each monitored component as the quotient of the measured (or extrapolated) stress experienced by that mechanical component over the load limit of that mechanical component.

According to another example, a wear severity index can also be defined for each monitored component as the quotient of the dynamic load capacity over the product of the equivalent force and the weaving speed.

These two severity indices show the use of the machine 4 relative to its maximum load capacity and its wear capacity, respectively.

According to yet another example, a power severity index can be calculated as the average, over a weave cycle, of the product of the speed of the weaving loom and the torque exerted on the input shaft 6, this average being divided by a reference value.

This severity index shows the energy consumption of the machine 4 relative to predefined limits.

These indices can be calculated per pick or for a weave length (i.e., for a weave cycle).

In one particular example, an weave severity index can be calculated as the number of times that frames perform the following actions over the duration of a weave cycle:

- initiates a movement from a high position to a low position;
- initiates a movement from a low position to go up to a high position;
- continues a movement from a high position to descend to a low position;
- continues a movement from a low position to a high position;
- this number is then divided by the product of the weave cycle and the number of frames used in the weave. This weave severity index places the number of moves required by the weave against the maximum number of moves possible.

These examples can be transposed to other mechanical components of the machine 4, using different sensors and/or theoretical models, for example.

According to embodiments, the control device 14 is further programmed, for each step of the predefined position sequence, to automatically compare the position of each frame 10 of the weaving loom with a target position imposed by the predefined position sequence. This makes it possible to detect possible false hits during weaving.

For example, for each pick, the control device 14 compares the position of the frame 10 determined from the sensors 38 with the weave-compliant position of the frame 10 transmitted by the control device 16 of the weaving loom 2 to the control device 14, for each blade.

If a deviation is identified as a result of the comparison, then the information is stored in the maintenance file 30 in association with the related blade and can be transmitted to the control device 16.

According to embodiments, the control device 14 is further programmed to automatically calculate a cumulative damage index for at least some of the textile machine components, defined as the state of wear of the component relative to a reference state.

For example, in the case of the mechanical transmission components 8, a cumulative damage index can be calculated with reference to the mechanical links such as bearings involved in the transmission kinematic chain associated with each frame 10.

In the case of the dobby, the blade joints are bearings whose lifespan can be estimated by conventional models requiring the knowledge of operating variables such as the applied force, the amplitude of the movement and its frequency. Parameters associated with operating conditions such as temperature, type of lubrication, etc. can also be added.

From the dynamic load capacity and the operating variables, a service lifespan can be estimated.

For example, the fatigue lifespan of bearings is given according to the Lunberg theoretical model by the following formula:

$$Lh = a3 * \frac{10^6 * 360}{60 * Vit * Osc} * \left(\frac{Cdyn}{\text{Féqui}}\right)^p \quad \text{[Math 2]}$$

Where "Lh" refers to the lifespan in hours, a3 is a lifespan correction factor, taking into account operating conditions such as lubrication. It is derived from experience and may include variations calculated from the measured oil temperature.

Vit is the operating speed of the weaving loom in strokes per minute,

Osc is the angle of oscillation during a stroke in degrees, and "p" is an exponent worth 3 for ball bearings and 10/3 for roller bearings.

Each weave cycle performed can be assimilated to a damage that can be defined as the ratio of the rate duration to the calculated theoretical lifespan.

The accumulation of these damages constitutes a damage rate and shows a percentage of the theoretical lifespan of the mechanical component.

The control device 14 also calculates the damage rate of the lubricating oil. The oil is subject to aging, the speed of which depends on the operating temperature and the stress level. The control device 14 has an oil temperature measurement and a torque measurement that shows the load intensity. For each weave, the control device 14 can calculate a damage rate.

For each pick, the control device 14 performs comparisons between the measured or extrapolated maximum stress level and the maximum stress limits of the components. If this is exceeded, it registers this for the related mechanical component and associates it with the weaving loom 2. For example, for each pick, the control device 14 compares the maximum torque measurement with a maximum torque limit value that can be supported by the dobby. If the control device 14 concludes that the maximum torque is exceeded by 20%, it records the occurrence. If the overrun is more than 50%, the control device 14 registers the occurrence and transmits a stop request to the weaving loom with an error code that allows the weaving loom to display the appropriate message.

In a variant, the control device 14 transmits the information via the internet connection to the remote server 22, for example, which can perform further analysis. In particular, the remote server 22 can implement more sophisticated models based on comparison with stresses collected in comparable applications.

The control device 14 receives the weave of the weaving loom and its length, i.e. the number of picks, called rate, at the end of which the weaving will continue by taking up the first pick. As soon as it receives the information about a weave change, the control device 14 starts recording the maximum force values in the first transmission rod 8 and of the torque on the input shaft, in successive rate s, until these values stabilize, i.e., for example, until the deviation between the maximum values measured for 5 consecutive rate s remains below 20% of the highest value. The maximum value is stored as the weave cycle reference value.

For each pick of the following rates, the control device 14 compares the maximum torque measurement with the maximum torque reference value of the weave. If it concludes that there is a 20% overshoot, it records the occurrence. If the overshoot is more than 50%, it registers the occurrence and transmits a stop request to the weaving loom 2 with an error code which allows the weaving loom 2 to display the appropriate message.

The control device 14 proceeds to record temperature measurements at regular intervals, such as every minute. It calculates a sliding average and, as soon as this average stabilizes, it registers a stabilized operating state, i.e. it records in the maintenance file 30 a start time of a stabilized operating period.

As explained above, for each pick or weave cycle or with each new oil rate, the control device 14 updates counters or damage rates. At the same time, these counters and damage rates are compared with predefined thresholds. Depending on the result of this comparison, a status variable is updated.

For example, for each blade, a damage rate is evaluated. The related status variable takes the value "RAS" (for "nothing to report", indicating a state that does not require maintenance) as long as it is less than 80%, then the value "to be monitored" as long as it remains less than 150% and "to be checked" above.

The control device 14 is connected to the remote server 22 which has access to all the maintenance data of the dobby in question but also of other dobbies of the same weave or of other weaves. The analysis of this data, which constitutes a database, can be used to refine the lifespan prediction models. Thus, the server 22 can compare the operating conditions of the dobby with conditions already recorded and possibly transmit modifications to the model. Thanks to the weave analysis principle, the server 22 only collects data that do not disclose the weave.

Based on the collected maintenance information, a maintenance program can be established. Knowledge of the damage rates of different machine components makes it possible to consider grouping replacement operations in order to limit the production downtime.

Following an intervention, the counters and the damage rates associated with the replaced elements must be initialized. In other words, the maintenance file 30 must be modified so that the counter or damage rate values are reset to zero. This can be done remotely via an interface in connection with the remote server 22. In a variant, it can be done via the screen of the weaving loom 2 on an interface in connection with the dobby control device 14.

The control device 14 has the ability to record false hits. The frequency of false hits can indicate a weakness in the electromagnets 40 and warrant their replacement.

From measurement of the angular position of the input shaft, the control device 14 can detect variations in speed during the completion of a pick. Large variations indicate a weakness in the drive and can account for abnormal force levels for the application.

When the lap speed variations exceed 20%, the control device 14 transmits the information via the internet connection to the remote server 22, which can perform additional analysis. In particular, it can implement more sophisticated models based on comparison with variations collected in comparable applications. The additional analyses can be used to determine whether these variations are detrimental to the lifespan of the dobby components. Indeed, strong speed variations when making a pick are accompanied by an increase in stress that is not detected if it remains compatible with the maximum stress limit.

This example can be transposed to other mechanical components of the machine 4, by using different sensors and/or theoretical models, for example.

Figure 2:
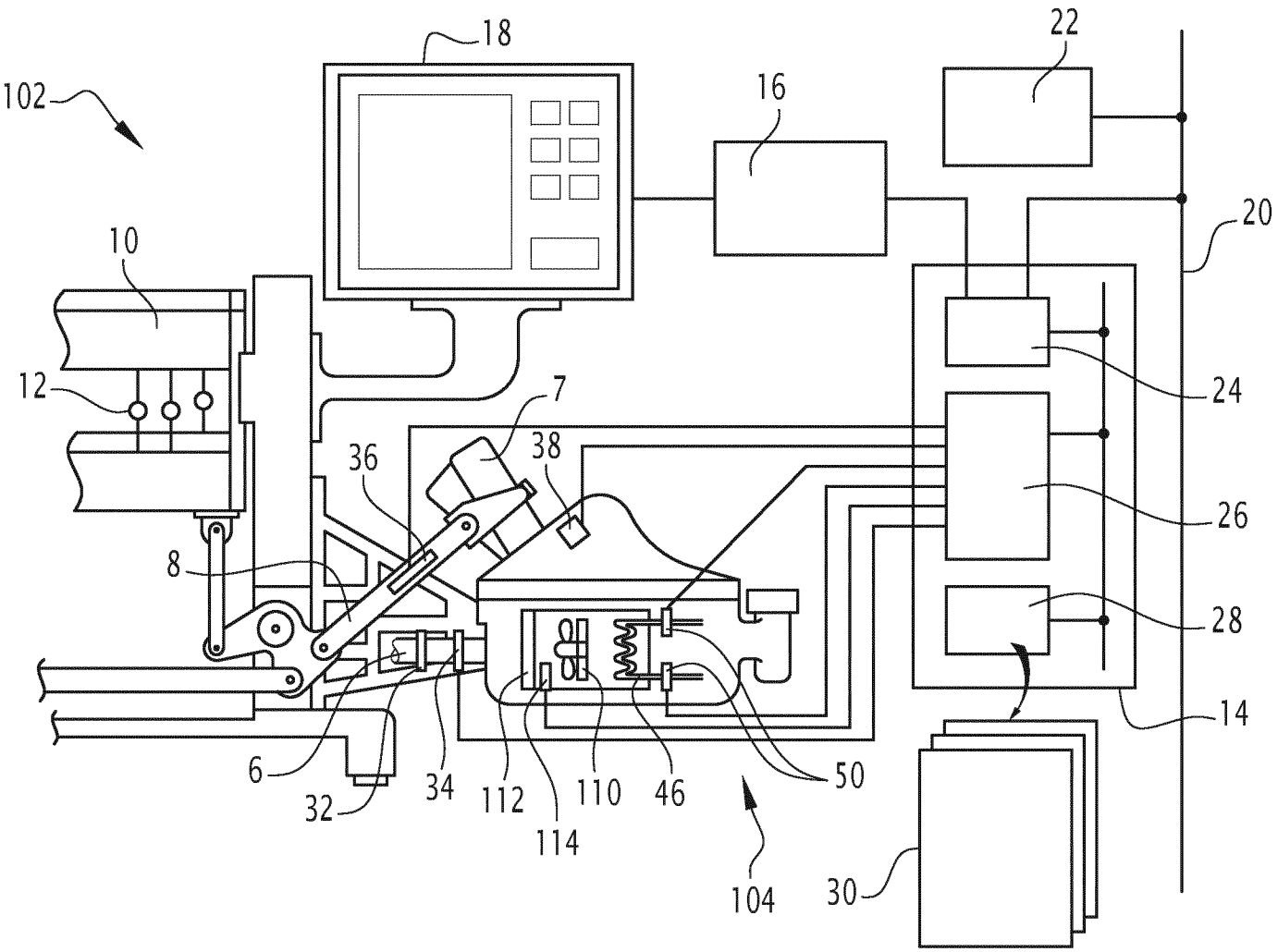
FIG. 2 shows a weaving loom comprising a basic dobby mechanism according to one embodiment of the invention.

FIG. 2 shows a second embodiment of the invention in which a weaving loom 102 is associated with a textile machine 104. The elements of the textile machine 104 according to this embodiment that are analogous to the first embodiment bear the same references and are not described in detail, insofar as the above description can be transposed to them.

In this example, the machine 104 is a basic weaving loom and differs in particular from the previously described machine 4 in that the movement of the output levers 7 is controlled by means of mechanical regulating means, for example by cams mounted on a motor shaft internal to the machine 104 and driven by the input shaft 6.

In other words, the weave is here defined mechanically, by arranging cams having a particular geometry on a shaft, and the machine 104 does not have means to reprogram the weave electronically. To modify the weave, the user must stop the machine 104 and then disassemble the cams and replace them.

The machine 104 is equipped with a leveling system that automatically places the frames in a crossing position during the loom stop phases, in order to release the tension in the warp threads. The leveling of the frames is obtained by moving the shaft of the output levers 7 away from the camshaft. This allows access and removal when changing weaves.

The other elements of the machine 104 are similar to those of the machine 4, particularly with respect to the control device 14, except that the control device 14 is not programmed here to control the movement of the output levers 7.

Furthermore, the operation of the monitoring method, as well as the construction of the maintenance indicators, is similar to that described above. Furthermore, the position of the frames 10 is identified by the control device 14 from the information provided by the position sensors 38.

Like the machine 4, the machine 104 is configured to transform the continuous rotational movement of the shaft 6 into a plurality of alternating translational movements of the frames 10 between a high and a low position according to the predefined sequence of positions imposed by the weave.

The machine 104 also includes a measuring device comprising one or more sensors similar to those of the machine 4.

In particular, the measuring device here includes a torque sensor 32, an angle sensor 34, force sensors 36, proximity sensors 38 and temperature sensors 50 such as those described above. However, the position of the temperature sensors can be modified to account for differences between the machine 104 and the machine 4. In a variant, the angle sensor 34 is omitted.

However, other sensors may be added. In this example, in order to be cooled, the oil circulating in the lubrication circuit 46 passes through an exchanger subjected to a flow of air drawn by a fan 110 through an air filter 112.

The measuring device therefore further comprises a pressure sensor 114 arranged upstream of the fan 110, here in the air stream between the fan 110 and the filter 112.

The pressure sensor 114 provides information about the fouling level in the air filter 112. A status variable associated with the air filter 112 can thus be defined in one of the maintenance files 30 and automatically updated by the control device 14 by comparing the pressure measurement against one or more predefined reference values.

According to an illustrative and not necessarily limiting example, the status variable is set to a "normal" level as long as the pressure remains less than or equal to 80% of a reference threshold, to a "to be monitored" level as long as the pressure is between 80% and 150% of the reference threshold, and to a "to be cleaned" level when the pressure exceeds 150% of said threshold.

Therefore, the control device performs a weave recognition based on the position information from the proximity sensors 38. For each frame used, it reconstructs the sequence of high or low positions occupied by the frame at each pick.

It can then determine whether, at each pick and for each frame:

- the frame 10 remains stationary in a high position;
- the frame 10 remains stationary in a low position;
- the frame 10 initiates a movement from a high position to a low position (the frame having remained stationary in the previous step);
- the frame 10 initiates a movement from a low position to a high position (the frame having remained stationary in the previous step);
- the frame 10 continues a movement from a high position to a low position (the frame having already moved in the previous step);
- the frame 10 continues to move from a low position to a high position (the frame having already moved in the previous step).

This information increments the counters associated with each blade. Thus, only information from which it is not possible to reconstitute the weave is kept for maintenance purposes. The confidentiality in principle of the application is assured.

Since there is no sensor for the angular position of the input shaft, the weaving speed is collected from the control device 16 of the weaving loom as well as the information relating to the mode of operation.

At each leveling operation, the control device 14 updates a leveling counter associated with the leveling component.

Figure 3:
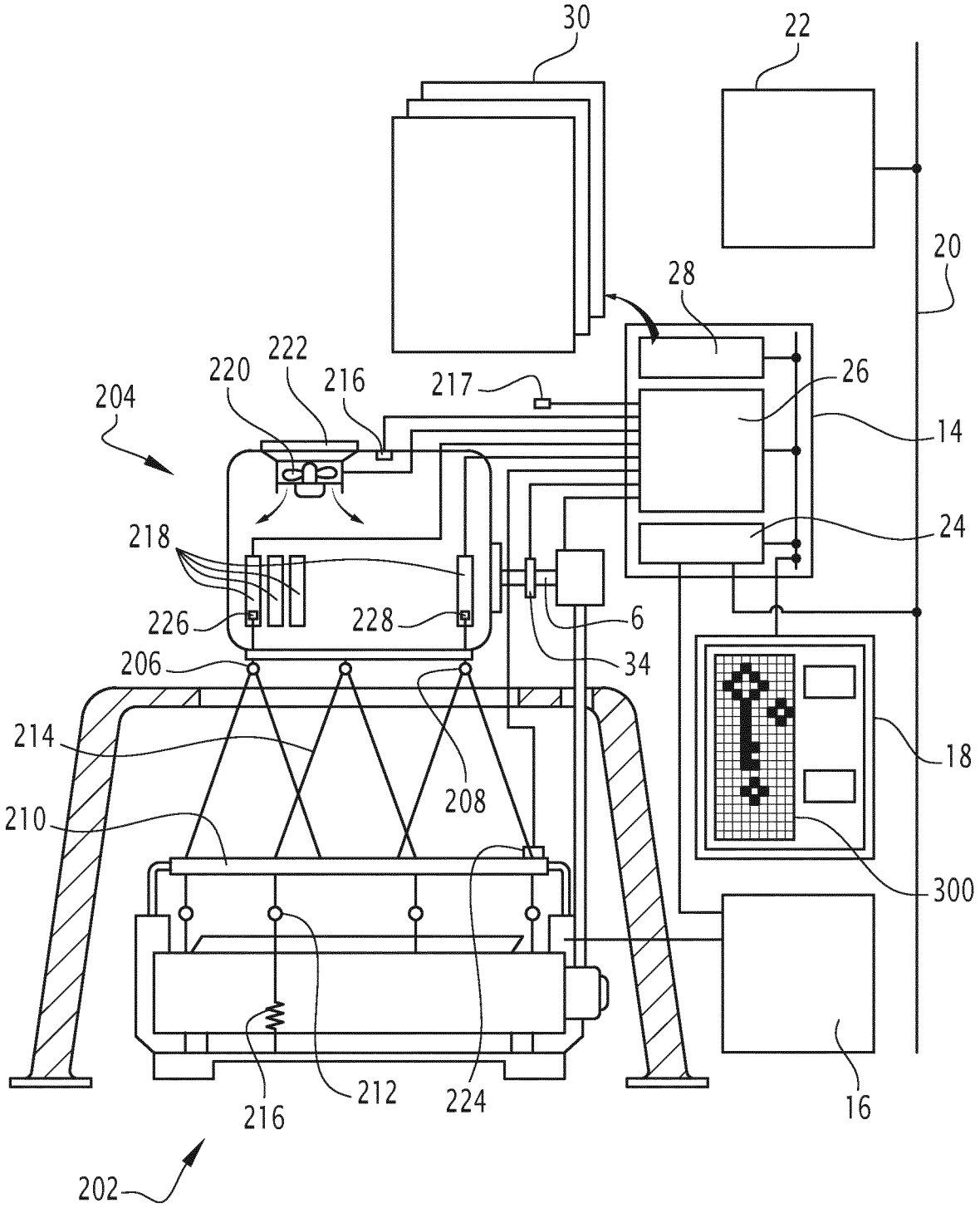
FIG. 3 shows a weaving loom having a Jacquard mechanism according to one embodiment of the invention.

FIG. 3 shows a third embodiment of the invention in which a weaving loom 202 is associated with a textile machine 204.

The textile machine components according to this embodiment that are analogous to the first embodiment bear the same references and are not described in detail, inasmuch as the above description can be transposed to them.

In this example, the machine 204 is a Jacquard machine configured, as known, to transform by kinematics, called control, the continuous rotational movement of the input shaft 6 into a vertical oscillation movement of knives connected to collars through mechanical elements such as hooks or pulleys.

Each collar drives two sets of yokes 214 each consisting of a rope connected to a heald 212 and a spring 216. In the illustrated example, reference 206 refers to the collar associated with the first feeder row and reference 208 refers to the collar associated with the last feeder row.

For ease in reading the Figure, the intermediate collars are not identified or even all drawn, but it is nevertheless understood that what is described generally with reference to the collars 206 and 208 also applies to the intermediate collars.

The vertical oscillation of each collar 206, 208 induces a displacement of each heald 212 relative to the feeder board 210.

For example, the electronic control device 14 is programmed to automatically control the positioning of the collars 206, 208 in a position consistent with a set position imposed by the weave, while taking into account the angular position of the input shaft 6, so that the collars 206, 208 are moved in synchronization with the movement of the weaving loom 202.

For example, each collar 206 is integral with the end of a cord that winds on the lower pulley of a hitch and whose other end is fixed. A second cord with a hook at each end is wound on the upper pulley of the hitch. The input shaft 6 sets in motion two series of knives capable of driving the hooks in phase opposition. The control device 14 controls a hook holding device by energizing or de-energizing electromagnets. When both hooks associated with a collar are retained, the collar remains in the up position. For example, eight collar selection devices are grouped in each selection module 218. In the illustrated example given for illustrative purposes only, the machine 204 is a Jacquard machine having 2688 collars arranged over a depth of sixteen collars.

It is thus understood that the collars in the machine 204 play a role comparable to that of the frames 10 of the machines 4 and 104.

Advantageously, a fan 220 equipped with an air filter 222 allows the interior of the machine 204 to be cooled.

The control device 14 is similar to that of the machine 4 but has its own interface 18 equipped with a touch screen 300 that makes it possible to edit the weave in order to be able to modify it, for example. The other elements of the machine 204 are similar to those of the machine 4.

Furthermore, the operation of the monitoring method, as well as the construction of the maintenance indicators, are similar to what has been described with reference to the other embodiments, with the difference that some of the indicators defined with reference to the frames 10 are here defined with reference to the collars.

Notably, the control device 14 is configured here to monitor the change in position of each collar during each step of the predefined sequence of positions and to count the number of times each collar is in a particular configuration.

The machine 204 also includes a measuring device comprising one or more sensors similar to those of the machines 4 and 104 previously described.

In particular, the measuring device here includes:

- a sensor 32 of torque exerted on the input shaft 6,
- an sensor 34 of the angle exerted on the input shaft 6,
- temperature sensors 216 and 217 respectively placed inside and outside a cover of the machine 204,
- a pressure sensor, not referenced but similar to the sensor 112, for measuring the pressure upstream of the fan 220 and downstream of the air filter 222,
- sensors mounted on the feeder board 210 to measure the temperature, humidity and cleanliness of the air, these sensors collectively identified in FIG. 3 by reference 224, although these sensors could be mounted separately in a variant;
- a sensor 226 of the force associated with the collar 206 associated with the first feeder row, and
- a sensor 228 of the force associated with the collar 208 associated with the last feeder row.

In this case, the collars 2688, the drive, oil, and air filter are listed in the maintenance file 30. A dynamic load capacity and a maximum stress limit are associated with the drive and to each of the collars.

For each pick in normal weaving mode, the control device 14 implements different processes based on the measurements collected and the information coming from the weaving loom 202. These processes are similar to those implemented for the machine 4 but apply for different components.

The control device 14 has the weave, also called pattern, in the case of Jacquard weaving. The weave does not necessarily come from the weaving loom control device 16 202 or from an analysis, but resides in a memory of the control device 14, which can then determine for each pick and, for each collar, whether the collar:

- remains stationary in a high position;
- remains stationary in a low position; or
- initiates a movement from a high position to a low position (the collar having remained stationary in the previous step);
- initiates a movement from a low position to move up to a high position (the collar having remained stationary in the previous step);
- continues a movement from a high position to a low position (the collar having already moved in the previous step);
- continues a movement from a low position to a high position (the collar having already moved in the previous step).

This information increments the counters associated with each collar. Thus, only information from which it is not possible to reconstitute the weave is kept for maintenance purposes. The confidentiality in principle of the application is ensured.

The control device 14 has a memory of the characteristics of the pulley train, i.e. the comber depth, the number of paths, etc., which enables it to determine the stroke of each collar. The forces at each collar can thus be extrapolated from the minimum stroke measurements taken on the collar 206 of and the maximum stroke measurements on the collar 208.

Similar to the previous embodiments, the control device 14 determines severity indices. However, in practice, the lifespan model used for the collars is empirical and is based on evaluating the product of the stroke, load and weaving speed. The severity index associated with the collars is then the rate of this product to a reference value.

The control device 14 has air humidity and opacity measurements and an ambient air temperature measurement. This information is used to evaluate the pollution that typically accelerates the wear of the harness components, in the form of an application severity index.

Calculation of the damage rate of the yoke assemblies can take into account measurements of the feeder board temperature, air humidity and opacity, and ambient air temperature provided by the sensors 224.

FIG. 4 shows a simplified diagram of a method for operating a measurement system equipping a textile machine 4, 104, 204 in accordance with embodiments of the invention, in particular in order to construct one or more maintenance indicators as previously defined.

The method begins with an initialization step 1000, corresponding, for example, to the start-up of the machine 4, 104, 204 and the weaving loom 2, 102, 202 at the start of the weaving method.

The control device 14 will implement two series of steps recurring at each pick and weave cycle, respectively, while the weaving loom is in weaving mode.

In a first step 1002, the control device 14 acquires the position measurements and compares them with the position of the frame or collar in accordance with the weave. If the positions do not match, then there is a weave default.

In a step 1004, the control device 14 proceeds to analyze the position of the frames and collars by identifying one of the following particular configurations:

- the frame or collar remains stationary in a high position;
- the frame or the collar remains stationary in a low position;
- the frame or collar initiates a movement from a high position to a low position;
- the frame or collar initiates a movement from a low position to a high position;
- the frame or collar continues a movement from a high position to a low position;
- the frame or collar continues a movement from a low position to a high position.

The control device 14 then increments a counter for each blade or collar associated with the particular recognized configuration.

In a step 1006, the control device 14 records the updated counters as well as the weave defaults in the maintenance file 30.

In parallel to steps 1002 to 1006, in a step 1020, the control device 14 acquires force measurements, for example by means of the acquisition unit 26, over the range of the weave cycle and determines equivalent forces, maximum forces and reference forces.

In a step 1022, the control device 14 elaborates the severity indices and damage rates.

In a step 1024, the control device develops state variables corresponding to the calculated severity indices and damage rates. For example, for each blade or collar, a damage rate is evaluated. The related state variable takes the value "RAS" as long as it is lower than 80%, then the value "to be monitored" as long as it remains lower than 150% and "to be controlled" above.

In a step 1026, the control device 14 records the updated severity indices and damage rates in the maintenance file 30.

Thus throughout the weaving process, the control device 14 automatically builds one or more maintenance indicators for each frame or collar.

Advantageously, in parallel, all or part of the information measured by the sensors of the measuring device can be used to build additional maintenance indicators, which give information on the condition of components other than the mechanical components of the kinematic transmission chain.

It is then possible at any time during the weaving process to access maintenance indicators, such as weave configuration counters, severity indices, damage rates and status variables. Advantageously, the weaving loom can come and read the maintenance indicators in order to display them on the interface 18. Similarly, the remote server 22 can access the maintenance file 30 to establish a diagnosis of the general condition of the textile machine.

According to embodiments, some or all of the indicators may be calculated by a computer or electronic device other than the control device 14, by the remote computer server 22 for example. Thus, optionally, the acquired data and/or counter values may be sent to the remote server 22 via the communication network 20.

According to yet another embodiment, the indicators calculated by the control device 14, as well as the maintenance files 30, may be sent to the remote computer server 22.

The invention is not limited to the components detailed in the embodiments and could apply to other mechanical or electronic components.

The invention is not limited to the types or location of the given sensors. For example, the position of the frames (or collars) at each pick could result from analysis of an image taken at the frames or a transmission element levels. It could also result from the analysis of force signals, as each blade or collar would be equipped with a force sensor.

The invention is described with control devices capable of implementing the various processes, some of which are sophisticated and require computing power. Some calculations, such as that of the equivalent force, could be exported to the remote server 22 from the moment the force signals (or values showing these force signals) are transferred to the remote server 22.

The calculation of the rate reference values used in the drift detection can be exported to the remote server 22.

In general, a damage rate evaluation is difficult because on the one hand, it uses approximate models that require a lot of data and on the other hand, differences in longevity exist between identical components. Therefore, it seems more rational to develop and provide the weaver with status variables such as "RAS", "To be monitored" or "Recommended change". It is then possible to envisage, at the request of the weaver, to proceed with a precise evaluation of the state of the dobby (machine 4), of the dobby mechanics (machine 104) or the Jacquard mechanics (machine 204) at the level of the remote server 22 by transferring the data and the measurements. Thanks to the weave analysis, the health diagnosis can be done at the remote server 22 without the weave being transferred.

The invention is applicable to shedding devices equipped with an input shaft driven directly by an actuator controlled by the control device 14 of the textile machine or by the control device 16 of the weaving machine. The input shaft 6 is then coupled to the weaving machine.

In the given descriptions of embodiments of the invention, the predefined position sequences refer to two possible frame or collar positions. The invention is also applicable to three-position weaving in which the frame or collar position is either high, intermediate position or low. These three positions create two overlapping sheds for double sheet weaving.

Thus, in such an example, the particular configurations correspond to the following particular configurations of the frame 10 (or, if applicable, the collar) for each step (each pick) of the predefined sequence of movements:

the frame 10 remains stationary in a high position;

the frame 10 remains stationary in a low position;

the frame 10 remains stationary in an intermediate position;

the frame 10 initiates a movement from a high or intermediate position to a low position (the frame having remained stationary in the previous step);

the frame 10 initiates a movement from a low or intermediate position to a high position (the frame having remained stationary in the previous step);

the frame 10 continues a movement from a high or intermediate position to a low position (the frame having already moved in the previous step);

the frame 10 continues a movement from a low or intermediate position to a high position (the frame having already moved in the previous step).

The invention is not limited to the particular configurations described. For example, the particular configurations may simply be:

the frame or collar is high, the frame or collar is low.

These particular configurations may be relevant and sufficient to evaluate maintenance indicators for certain Jacquard applications. Indeed, the force applied to the collars may mainly depend on the spring return, while the dynamic force associated with the movement is negligible.

The embodiments and variants contemplated above can be combined with each other to give rise to new embodiments.

The invention claimed is:

1. A textile machine for a weaving loom, comprising:

an input shaft configured to be coupled to a weaving loom;

a drive mechanism actuated by the input shaft and configured to move frames or collars of the weaving loom through a predefined sequence of positions, said drive mechanism having at least one mechanical output component configured to be coupled to one of said frames or collars of the weaving loom;

an electronic control device including a processor and a computer memory, wherein said control device is programmed to monitor the change in position of each frame or collar during each step of the predefined sequence of positions and to count the number of times each frame or collar reproduces a particular configuration, wherein the control device is further programmed to automatically calculate a cumulative damage index for at least some of the textile machine components, defined as the state of wear of the component relative to a reference state, and wherein the control device is further programmed to automatically compare the damage index, for at least some of the textile machine components, to a predefined value and to update a state variable representing the comparison.

2. The textile machine according to claim 1, wherein said particular configurations include the following transitions of the frame or collar for each step of the predefined sequence of positions:

the frame or collar remains stationary in a high position;

the frame or collar remains stationary in a low position;

the frame or collar initiates a movement from a high position to a low position;

the frame or collar initiates a movement from a low position to a high position;

the frame or collar continues a movement from a high position to a low position;

the frame or collar continues a movement from a low position to move up to a high position.

3. The textile machine according to claim 1, wherein the machine further comprises a measuring device comprising one or more sensors configured to measure one or more of the following quantities, for each step of the predefined position sequence:

a force exerted on a mechanical component;

a torque exerted on a mechanical component; and a position of one or more of the frames or collars;

an angle of the input shaft;

a speed of rotation of the input shaft;

an environmental variable such as a temperature, or a viscosity, or a pressure, or an opacity.

4. The textile machine according to claim 1, wherein the control device is programmed to calculate, for a measured quantity, a reference value over a weave cycle and, for each weave cycle, to automatically compare the measured quantity with the reference value.

5. The textile machine according to claim 1, wherein the control device is programmed, for each step of the sequence of predefined positions, to automatically compare the position of each frame or collar of the weaving loom with a target position imposed by the sequence of predefined positions.

6. The textile machine according to claim 1, wherein the control device is programmed to automatically calculate a severity index, for at least some of the textile machine components, defined as a current level of use of the component relative to an intrinsic limit of the component.

7. The textile machine according to claim 6, wherein the control device is further programmed to automatically compare a severity index, for at least a portion of the textile machine components, to a predefined value and to update a status variable representing the comparison.

8. The textile machine according to claim 1, wherein the textile machine is a shedding device, such as a fundamental weave machine, or a dobby, or a Jacquard machine.

9. The textile machine according to claim 8, wherein the control device has memory comprising a maintenance file containing for at least one of the textile machine components the recording of counters or a severity index or a damage rate.

10. The textile machine of claim 9, wherein the textile machine components recorded in the maintenance file include one or more of the following components:

blades or collars, electromagnets selection modules, filters, oil.

11. The textile machine according to claim 1, wherein the control device is adapted to communicate with a remote server.

12. A system comprising a weaving loom and a textile machine according to claim 1, said textile machine being coupled to the weaving loom.

13. A method for operating a textile machine for a weaving machine, said textile machine comprising:

an input shaft, configured to be coupled to a weaving loom;

a drive mechanism, actuated by the input shaft and configured to move frames or collars of the weaving loom in a predefined sequence of positions, said drive mechanism having at least one mechanical output component configured to be coupled to one of said frames or collars of the weaving loom;

an electronic control device including a processor and a computer memory, wherein the method comprises monitoring the change in position of each frame or collar of the weaving loom during each step of the predefined sequence of positions and counting the number of times each frame or collar reproduces a particular configuration, and wherein the method further comprises, for at least a portion of the textile machine components:

calculating a cumulative damage index defined as the state of wear of the component relative to a reference state, comparing the damage index to a predefined value;

updating a status variable representing the comparison.

14. The method according to claim 13, the method further comprising automatically calculating a maintenance indicator representing a wear condition of one or more mechanical textile machine components from the recorded position data of each frame or collar.

* * * * *